US010249255B2

(12) United States Patent
Yun

(10) Patent No.: US 10,249,255 B2
(45) Date of Patent: Apr. 2, 2019

(54) METHOD FOR DRIVING DISPLAY PANEL HAVING A PLURALITY OF VOLTAGE LEVELS FOR GATE SCANNING SIGNALS

(71) Applicant: BOE TECHNOLOGY GROUP CO., LTD., Beijing (CN)

(72) Inventor: Saichang Yun, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/550,492

(22) PCT Filed: Mar. 10, 2017

(86) PCT No.: PCT/CN2017/076262

§ 371 (c)(1),
(2) Date: Aug. 11, 2017

(87) PCT Pub. No.: WO2018/040534

PCT Pub. Date: Mar. 8, 2018

(65) Prior Publication Data

US 2018/0240428 A1 Aug. 23, 2018

(30) Foreign Application Priority Data

Aug. 31, 2016 (CN) ..... 2016 1 0798537

(51) Int. Cl.
*G09G 3/36* (2006.01)

(52) U.S. Cl.
CPC ..... *G09G 3/3677* (2013.01); *G09G 3/3648* (2013.01); *G09G 2310/06* (2013.01);
(Continued)

(58) Field of Classification Search
CPC ..... G09G 3/3677
(Continued)

(56) References Cited

U.S. PATENT DOCUMENTS

2010/0149157 A1* 6/2010 Shih ..... G02F 1/13624 345/211
2010/0164854 A1 7/2010 Kim et al.
(Continued)

FOREIGN PATENT DOCUMENTS

CN 101191920 A 6/2008
CN 101699552 A 4/2010
(Continued)

OTHER PUBLICATIONS

International Search Report & Written Opinion dated May 27, 2017, regarding PCT/CN2017/076262.
(Continued)

*Primary Examiner* — Long D Pham
(74) *Attorney, Agent, or Firm* — Intellectual Valley Law, P.C.

(57) ABSTRACT

The present application discloses a method of driving gate lines of a display panel. The method includes generating a gate scanning signal; and providing the gate scanning signal to a gate line of the display panel. The gate scanning signal includes two or more high voltage levels in consecutive two or more time periods of a single scanning stage for turning on each of a plurality of thin film transistors coupled to the gate line.

11 Claims, 3 Drawing Sheets

(52) U.S. Cl.
CPC . *G09G 2310/08* (2013.01); *G09G 2320/0223* (2013.01); *G09G 2320/0233* (2013.01)

(58) Field of Classification Search
USPC ..... 345/210
See application file for complete search history.

(56) References Cited

U.S. PATENT DOCUMENTS

| | | | | |
|---|---|---|---|---|
| 2012/0038610 | A1* | 2/2012 | Li | G09G 3/3696 345/211 |
| 2013/0321386 | A1* | 12/2013 | Murai | G09G 3/3648 345/213 |
| 2016/0203753 | A1 | 7/2016 | Hwang et al. | |
| 2017/0039979 | A1 | 2/2017 | Hu et al. | |
| 2017/0169787 | A1 | 6/2017 | Zhang | |

FOREIGN PATENT DOCUMENTS

| | | | |
|---|---|---|---|
| CN | 102074180 | A | 5/2011 |
| CN | 102968969 | A | 3/2013 |
| CN | 104778931 | A | 7/2015 |
| CN | 104966505 | A | 10/2015 |
| CN | 105609079 | A | 5/2016 |
| CN | 105788502 | A | 7/2016 |
| KR | 20080069441 | A | 7/2008 |

OTHER PUBLICATIONS

First Office Action in the Chinese Patent Application No. 201610798537.6, dated Mar. 27, 2018; English translation attached.

* cited by examiner

METHOD FOR DRIVING DISPLAY PANEL HAVING A PLURALITY OF VOLTAGE LEVELS FOR GATE SCANNING SIGNALS

CROSS-REFERENCE TO RELATED APPLICATION

This application claims priority to Chinese Patent Application No. 201610798537.6, filed Aug. 31, 2016, the contents of which are incorporated by reference in the entirety.

TECHNICAL FIELD

The present invention relates to display technology, particularly to a display substrate, a method for driving display substrate, and a display apparatus.

BACKGROUND

Thin film transistor liquid crystal display (TFT-LCD) apparatuses have many advantages including low power consumption, high display quality, being radiation free, and low manufacture costs, and have found a wide range of applications in display field such as televisions, mobile phones, personal digital assistants (PDAs), digital cameras, computer screens, and laptop screens. TFT-LCD apparatus includes a thin film transistor array substrate, a color filter substrate, and a liquid crystal layer between the two substrates. During a process of driving TFT operation in the array substrate, gate line delay of the driving signal often causes subpixel charging non-uniformity.

SUMMARY

In one aspect, the present invention provides a method of driving gate lines of a display panel, the method comprising generating a gate scanning signal; and providing the gate scanning signal to a gate line of the display panel; wherein the gate scanning signal comprises two or more high voltage levels in consecutive two or more time periods of a single scanning stage for turning on each of a plurality of thin film transistors coupled to the gate line.

Optionally, the two or more high voltage levels include a first voltage level provided in a first time period followed by a second voltage level in a second time period, the second voltage level being higher than the first voltage level.

Optionally, the second time period is longer than the first time period.

Optionally, a last one of the two or more high voltage levels comprises a highest voltage level provided in a last time period till an end of the scanning stage, the last time period being set to a longest time period among the two or more time periods, the highest voltage level being set to be higher than a predetermined voltage value sufficient for turning on a thin-film transistor.

Optionally, the two or more high voltage levels include a first voltage level provided in a first time period followed by a second voltage level in a second time period, the second voltage level is lower than the first voltage level.

Optionally, the first voltage level is a highest voltage level set to be higher than a predetermined voltage value sufficient for turning on a thin-film transistor.

Optionally, the first time period is a longest time period among the two or more time periods.

Optionally, the gate scanning signal comprises n numbers of high voltage levels stepwise changing from a first voltage level up to a n-th voltage level respectively in n consecutive time periods of a single scanning stage for turning on each of a plurality of thin film transistors coupled to the gate line, n being an integer greater than 1.

Optionally, the n-th voltage level is greater than a (n−1)-th voltage level of the n numbers of high voltage levels.

Optionally, the n-th time period is the longest time period among the n consecutive time periods.

Optionally, the n-th voltage level is set to be higher than a pre-determined voltage based on the display instruction for turning on a thin-film transistor.

Optionally, the n-th voltage level is smaller than a (n−1)-th voltage level of the n numbers of high voltage levels.

Optionally, the first time period is the longest time period among then consecutive time periods.

Optionally, the first voltage level is set to be higher than a predetermined voltage based on the display instruction for turning on a thin-film transistor.

Optionally, a difference between the n-th voltage level and a (n−1)-th voltage level among the n numbers of high voltage levels is set to be equal to that between a (n−1)-th voltage level and a (n−2)-th voltage level among the n numbers of high voltage levels, where $n \geq 3$.

Optionally, a (n−1)-th time period is equal to a (n−2)-th time period of the n time periods.

In another aspect, the present invention provides a display substrate configured to be driven by the method described herein, the display substrate comprises a plurality of subpixel units having a common gate line connected to an input port for receiving a gate scanning signal, wherein the gate scanning signal is applied to the plurality of subpixel units through the common gate line in a single scanning stage with two or more high voltage levels provided in consecutive two or more time periods throughout the single scanning stage for turning on each of a plurality of thin film transistors coupled to the common gate line.

In another aspect, the present invention provides a display substrate configured to be driven by the method described herein, the display substrate comprises a plurality of subpixel units having a common gate line connected to an input port for receiving a gate scanning signal, wherein the gate scanning signal is applied to the plurality of subpixel units through the common gate line in a single scanning stage with a first voltage level in a first time period, a second voltage level sequentially in a second time period, up to a n-th voltage level sequentially in a n-th time period, where $n \geq 2$.

In another aspect, the present invention provides a display apparatus comprising a display substrate described herein.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

Figure 1:
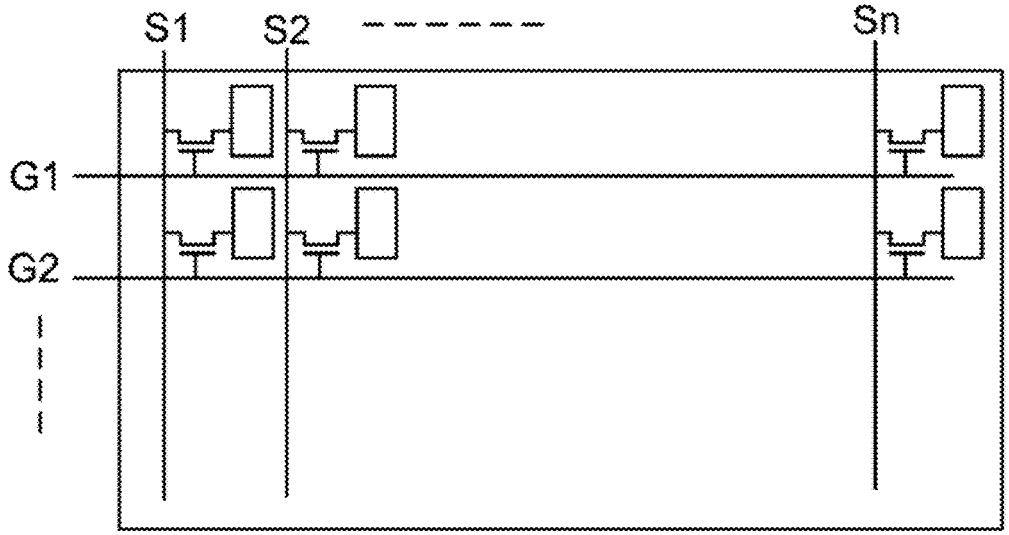
FIG. 1 Related Art
FIG. 1 is a schematic diagram of a typical display panel with array of subpixel units and gate line structures.

FIG. 1 shows a typical display panel having multiple subpixel units and gate lines for providing driving signals via corresponding input ports G1, G2, . . . . Those subpixel units located near the input port are near-point subpixel units. Those subpixel units located far away from the input port are far-point subpixel units.

Figure 2:
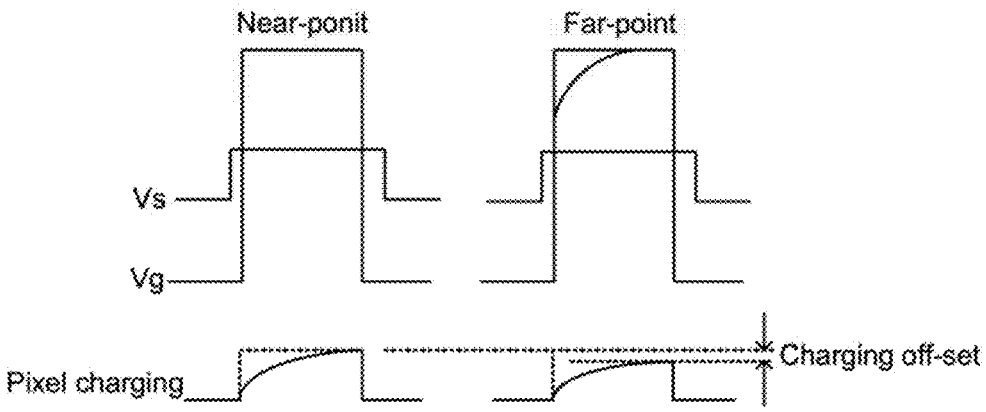
FIG. 2 Related Art
FIG. 2 is a schematic diagram showing driving signals applied to a near-point subpixel unit and a far-point subpixel unit in a conventional display panel.

FIG. 2 is a schematic diagram showing a driving signal applied to the near-point subpixel units and a driving signal applied to the far-point subpixel units. As shown, no or little gate line delay exists in the driving signal applied to the near-point subpixel units. There is, however, gate line delay in the driving signal applied to the far-point subpixel units, causing a large gate voltage variation from the near-point subpixel units to far-point subpixel units and in-turn resulting in non-uniformity in image brightness. In FIG. 2, the descending edges of the driving signals are shown as straight lines. Optionally, the descending edges of the driving signals are smoothly curved lines.

The latest technology for correcting non-uniformity of the gate voltages is to reduce load (such as impedance and capacitance) in the gate lines of the display panel. But as the trend of the LCD display product goes for high resolution and large dimension, the load in gate lines becomes even larger. Therefore, the non-uniformity issue in gate voltages remains a problem to be solved.

Accordingly, the present disclosure provides, inter alia, a display substrate, a display panel and a display apparatus having the same, and a method of driving the display substrate that substantially obviate one or more of the problems due to limitations and disadvantages of the related art. In one aspect, the present disclosure provides a method of driving gate lines of a display substrate of a TFT-based display apparatus. In some embodiment, the display substrate is a TFT array substrate including an array of subpixel units. Each row of the array includes a plurality of subpixel units controlled by a set of driving transistors having a common gate line coupled to an input port for receiving a gate scanning signal. The method includes providing a gate scanning signal to the plurality of subpixel units within each scanning stage. In some embodiments, the method includes providing a gate scanning signal to the common gate line connected to each row of thin-film transistors associated with the plurality of subpixel units within each scanning stage. In some embodiments, each scanning stage is divided into consecutive two or more time periods, e.g., a first time period and a second time period. Optionally, the gate scanning signal provides two or more high voltage levels in the consecutive two or more time periods of a single scanning stage for turning on each of a plurality of thin film transistors coupled to the gate line. Optionally, the two or more high voltage levels include a first voltage level provided in a first time period followed by a second voltage level in a second time period, the second voltage level being higher than the first voltage level. Optionally, the second time period is longer than the first time period. Optionally, a last one of the two or more high voltage levels comprises a highest voltage level provided in a last time period till an end of the scanning stage, the last time period being set to a longest time period among the two or more time periods, the highest voltage level being set to be higher than a predetermined voltage value sufficient for turning on a thin-film transistor. Optionally, the two or more high voltage levels include a first voltage level provided in a first time period followed by a second voltage level in a second time period, the second voltage level is lower than the first voltage level. Optionally, the first voltage level is a highest voltage level set to be higher than a predetermined voltage value sufficient for turning on a thin-film transistor. Optionally, the first time period is a longest time period among the two or more time periods.

In some embodiments, each scanning stage is divided into n different time periods sequentially from a first time period, a second time period, up to a n-th time period, where n is an integer greater than or equal to 2. Accordingly, the gate scanning signal provides n different voltage levels stepwise changing from a first voltage level to the plurality of subpixel units via the gate line in the first time period, a second voltage level in the second time period, and so on up to a n-th voltage level in the n-th time period.

Figure 3:
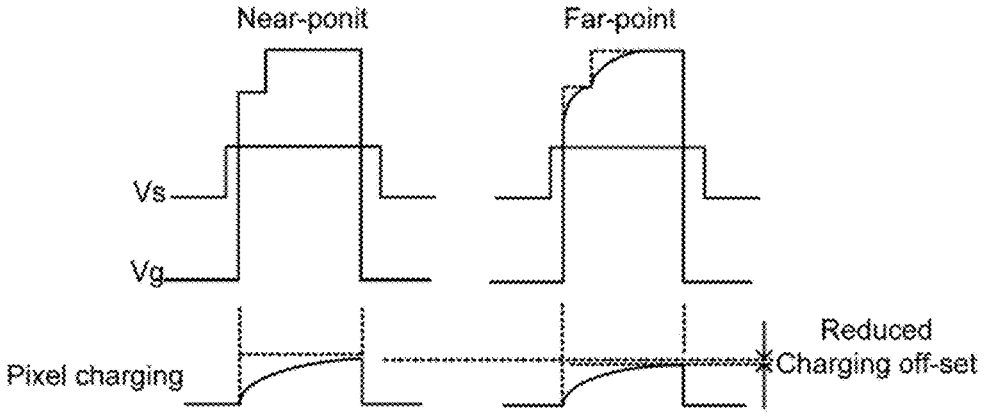
FIG. 3 is a schematic diagram showing driving signals applied to a near-point subpixel unit and a far-point subpixel unit in a display panel according to some embodiments of the present disclosure.

FIG. 3 is a schematic diagram showing gate scanning signals applied to a near-point subpixel unit and a far-point subpixel unit in a display substrate according to some embodiments of the present disclosure. FIG. 1 has shown the layout of subpixel array with near-point subpixel units and far-point subpixel unit relative to an input port for each row associated with a gate line, such as G1, G2, and more. Referring to FIG. 3, as an example, the scanning stage for applying the gate scanning signal with two-step voltage levels is divided into two corresponding time periods. By applying the gate scanning signal in two time periods, it is able to keep gate voltages for turning on thin-film transistors associated with near-point subpixel units substantially close to those for far-point subpixel units after respective gate charging processes. Therefore, subpixel charging offsets along gate line from near-point to far-point are reduced among those far-point subpixel units. As a result, displayed image of the TFT-LCD apparatus becomes more uniform with enhanced image resolution.

Optionally, as shown in FIG. 3, the gate scanning signal is configured to have the n-th voltage level to be greater than or equal to the (n−1)-th voltage level. In particularly, among all the n time periods including the first time period, the second time period, . . . , and the n-th time period, the n-th time period is set to be the longest time period. This setting allows power supply to each gate of subpixel unit to have enough time to reach to or be substantially close to the n-th voltage level, which can make the gate to properly perform its switching function for turning on the corresponding thin-film transistor associated with the subpixel unit. Optionally, the n-th voltage level is set to be larger than a predetermined gate scanning voltage which is just a voltage level of conventional gate scanning signal applied to the common gate line of the display substrate. In the present disclosure, the gate scanning signal within each scanning stage is applied via multiple different voltage levels stepwise changing respectively in multiple consecutive time periods. If the voltage level in each time period is set to be lower than the predetermined gate driving voltage, the voltage level for charging the gate throughout the entire scanning stage cannot reach the needed gate charging level provided by convention gate scanning signal in a single time period.

Referring to FIG. 3 for the example with the scanning stage being divided into two time periods, the first voltage level is applied to the gate line in the first time period and the second voltage level is applied to the gate line in the second time period. The first voltage level is smaller than the second voltage level. The second time period is greater than the first time period. Because maximum duration of the second time period as the second voltage level is applied to the gate line is longer than the first time period, the gate scanning signal can effectively turn on the thin-film transistors of the plurality of subpixel units connected to the gate line. By applying two different voltage levels in two sequential time periods, the gate voltages of near-point subpixel units after respective gate charging processes are more close to those of far-point subpixel units. Therefore, the subpixel charging offset along the gate line from near-point to far-point is reduced among the plurality of subpixel units and the image displayed by the TFT-LCD apparatus becomes more uniform along the gate line direction and can be provided with enhanced resolution.

Optionally, the n-th voltage level is set to be greater than the predetermined gate driving voltage and is maintained in a longest time period, the n-th time period, of the scanning stage. This setting allows that the gate charging voltage in the entire scanning stage can reach or at least be substantially close to the level provided by the conventional gate charging technology. Therefore, the method of driving the gate line connected to a plurality of subpixel units of the present disclosure can guarantee substantial uniform image to be displayed by both near-point subpixel units and far-point subpixel units. At the same time, the method ensures that the gate scanning signal can make corresponding gate line to reach the charging voltage needed for properly turning on the thin-film transistors respectively for the plurality of subpixel units.

In a specific embodiment, n=2, the second voltage level is set to be greater than or equal to the first voltage level. The scanning stage is divided into two time periods: the first time period followed by the second time period. The second time period is the longest time period. Because the second voltage level corresponding to the second time period is the largest voltage level so that the second time period is set to be the longest one to ensure the power supply for charging each gate of a subpixel unit can have enough time to reach (or at least be substantially close to) the second voltage level. This allows the gate scanning signal to properly turn on the thin-film transistor associated with the subpixel unit no matter it is in a near-point region or a far-point region. Optionally, the second voltage level is set to be larger than the predetermined gate scanning voltage under a conventional technique for providing a gate scanning signal to the gate line in a scanning stage with single time period.

Figure 4:
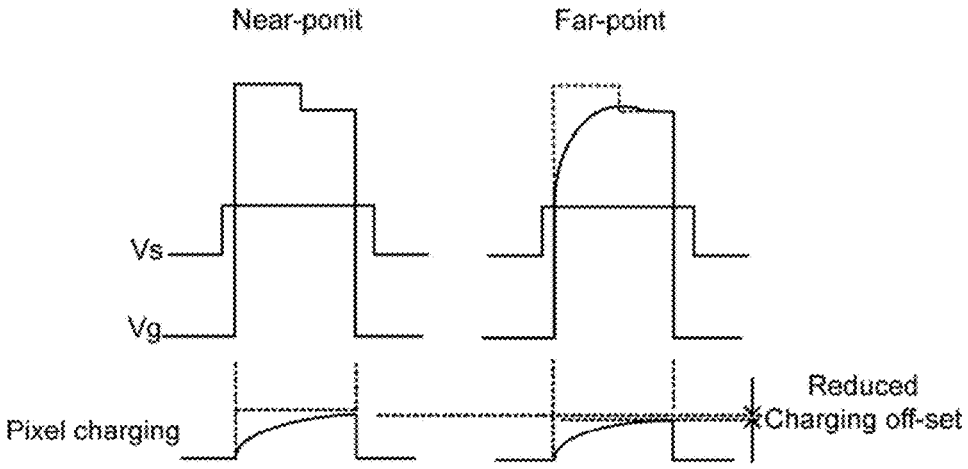
FIG. 4 is a schematic diagram showing driving signals applied to a near-point subpixel unit and a far-point subpixel unit in a display panel according to some embodiments of the present disclosure.

Alternatively, for n≥2 case, the n-th voltage level is set to be smaller than the (n−1)-th voltage level. FIG. 4 is a schematic diagram showing driving signals applied to a near-point subpixel unit and a far-point subpixel unit in a display panel according to some embodiments of the present disclosure. Referring to FIG. 4, among the n different time periods from the first time period, the second time period, . . . , to the n-th time period, the first time period is set to be a longest time period. This setting allows that the power supply for charging each gate of subpixel unit can have enough time to reach or at least be substantially close to the first voltage level (applied in the first time period) so that the gate scanning signal can properly turn on the corresponding thin-film transistor associated with the subpixel unit. Optionally, the first voltage level is set to be greater than a predetermined gate scanning voltage that is set under the conventional technique for providing a gate scanning signal to the gate line within a scanning stage with a single time period. As the gate scanning signal is provided with multiple voltage levels on the gate line stepwise changing in multiple consecutive time periods, if the voltage level is each time period is lower than the predetermined gate driving voltage, the gate charging voltage cannot reach the needed level in entire scanning stage under conventional technique for providing a gate scanning signal in a single time period. In the embodiment, the first voltage level is set to be greater than the predetermined gate driving voltage and the corresponding first time period for maintaining the first voltage level is set to be the longest time period. This setting allows that in a whole scanning stage the power supply for charging each subpixel unit can reach or be at least substantially close to the level provided under the conventional technique to ensure uniform images to be displayed by both the near-point subpixel units and the far-point subpixel units. At the same time, this setting allows the gate to properly control on-or-off states of the thin-film transistors associated with the plurality of subpixel units.

Optionally, for n≥3 case, a difference between the n-th voltage level and the (n−1)-th voltage level is set to be equal to a difference between the (n−1)-th voltage level and the (n−2)-th voltage level. By setting each time period of the n different time periods with an equal length and setting voltage difference equal, it is able to drive the gate charging voltage to reach a maximum value during the scanning stage which in-turn ensures that the gate scanning signal can properly turn on the thin-film transistors as needed. Optionally, the (n−1)-th time period is set to be equal to the (n−2)-th time period.

In another aspect, the present disclosure provides a display substrate that is driven by the method disclosed above. In some embodiments, the display substrate is a TFT array substrate including a plurality of subpixel units having a common gate line connected to an input port for receiving a gate scanning signal, wherein the gate scanning signal is applied to the plurality of subpixel units through the common gate line in a single scanning stage with two or more high voltage levels provided in consecutive two or more time periods throughout the single scanning stage for turning on each of a plurality of thin film transistors coupled to the common gate line. In some embodiments, the display substrate is a TFT array substrate including a plurality of subpixel units having a common gate line connected to an input port for receiving a gate scanning signal during a scanning stage. The scanning stage is divided into n time periods starting sequentially from a first time period, a second time period, . . . , up to a n-th time period. The gate scanning signal is generated for a plurality of subpixel units from a near-point to far-point as n different voltage levels respectively in n consecutive time periods stepwise changing from a first voltage level in a first time period, a second voltage level sequentially in a second time period, up to a n-th voltage level sequentially in a n-th time period, where n≥2 is an integer.

In some embodiments, within a scanning stage, for a near-point subpixel unit of the display substrate that is located near the input port of the gate line, the gate of a thin-film transistor associated with the near-point subpixel unit is applied with a voltage changing from the first voltage level, the second voltage level, . . . , and to the n-th voltage level that are increased stepwise. Within the same scanning stage, for a par-point subpixel unit of the display substrate that is located far from the input port of the gate line, the gate voltage of a thin-film transistor associated with the far-point subpixel unit is increased gradually to reach the first voltage level within the first time period, further increased gradually from the first voltage level to reach the second voltage level within the second time period, . . . , and further increased gradually from the (n−1)-th voltage level to become the n-th voltage level. In the whole scanning stage, the gate voltage of the near-point subpixel unit after gate charging is kept close to that of the far-point subpixel unit. Therefore, the thin-film transistors associated with the near-point subpixel units and the far-point subpixel units can be all turned on or off substantially at the same time to ensure that images displayed by those near-point subpixel units and those far-point subpixel units are more uniform in brightness.

In yet another aspect, the present disclosure provides a display apparatus including the display substrate described above. In particular, the display apparatus can be a liquid crystal display panel, a mobile phone, a tablet computer, a television, a displayer, a notebook computer, a digital frame, a navigation device and other products or components that have a display function. By adopting the display substrate, the display apparatus is a TFT-LCD apparatus configured to reduce rotation time of the liquid crystal molecules which in turn reduces response time of the liquid crystal layer for image display. In some embodiments, for a near-point subpixel unit of the display substrate of the display apparatus that is located near the input port of the corresponding gate line, a gate scanning signal in a scanning stage is applied with n different voltage levels increasing stepwise in n consecutive time periods of the scanning stage from the first voltage level in the first time period, the second voltage level sequentially in the second time period, . . . , and the n-th voltage level sequentially in the n-th time period. Within each scanning stage, for a par-point subpixel unit of the display substrate of the display apparatus that is located far from the input port of the corresponding gate line, the voltage that charges to the gate of a corresponding thin-film transistor associated with the far-point subpixel unit is increased gradually to reach the first voltage level within the first time period, further increased gradually from the first voltage level to reach the second voltage level within the second time period, . . . , and further increased gradually from the (n−1)-th voltage level to become the n-th voltage level. In the whole scanning stage, the voltage level charged on the near-point subpixel unit is kept close to that of charged on the far-point subpixel unit. Therefore, all the thin-film transistors associated with the near-point subpixel units as well as the far-point subpixel units can be turned on or off substantially at the same time to ensure that images displayed by those near-point subpixel units and those far-point subpixel units are more uniform in brightness.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A method of driving gate lines of a display panel, comprising:

generating a gate scanning signal; and providing the gate scanning signal to a gate line of the display panel;

wherein the gate scanning signal comprises two or more high voltage levels in consecutive two or more time periods of a single scanning stage for turning on each of a plurality of thin film transistors coupled to the gate line;

the gate scanning signal comprises n numbers of high voltage levels stepwise changing from a first voltage level to a n-th voltage level respectively in n consecutive time periods of a single scanning stage for turning on each of a plurality of thin film transistors coupled to the gate line, n>3, and a n-th time period being a longest time period among the n consecutive time periods;

a non-zero difference between the n-th voltage level and a (n−1)-th voltage level among the n numbers of high voltage levels is set to be equal to a non-zero difference between a (n−1)-th voltage level and a (n−2)-th voltage level among the n numbers of high voltage levels;

the n-th voltage level, the (n−1)-th voltage level, and the (n−2)-th voltage level are different from each other, the n-th voltage level being greater than the (n−1)-th voltage level, and the (n−1)-th voltage level being greater than the (n−2)-th voltage level;

each of the n-th voltage level, the (n−1)-th voltage level, and the (n−2)-th voltage level is different from the first voltage level.

2. The method of claim 1, wherein the two or more high voltage levels include a first voltage level provided in a first time period followed by a second voltage level in a second time period, the second voltage level being higher than the first voltage level.

3. The method of claim 2, wherein the second time period is longer than the first time period.

4. The method of claim 2, wherein a last one of the two or more high voltage levels comprises a highest voltage level provided in a last time period till an end of the single scanning stage, the last time period being set to a longest time period among the consecutive two or more time periods, the highest voltage level being set to be higher than a predetermined voltage value sufficient for turning on a thin-film transistor.

5. The method of claim 1, wherein the n-th voltage level is greater than a (n−1)-th voltage level of the n numbers of high voltage levels.

6. The method of claim 1, wherein the n-th voltage level is set to be higher than a pre-determined voltage based on a display instruction for turning on a thin-film transistor.

7. The method of claim 1, wherein a (n−1)-th time period is equal to a (n−2)-th time period of the n consecutive time periods.

8. A display substrate configured to be driven by the method of claim 1, the display substrate comprises a plurality of subpixel units having a common gate line connected to an input port for receiving a gate scanning signal, wherein the gate scanning signal is applied to the plurality of subpixel units through the common gate line in a single scanning stage with two or more high voltage levels provided in consecutive two or more time periods throughout the single scanning stage for turning on each of a plurality of thin film transistors coupled to the common gate line.

9. A display apparatus comprising the display substrate of claim 8.

10. A display substrate configured to be driven by the method of claim 1, the display substrate comprises a plurality of subpixel units having a common gate line connected to an input port for receiving a gate scanning signal, wherein the gate scanning signal is applied to the plurality of subpixel units through the common gate line in a single scanning stage with a first voltage level in a first time period, a second voltage level sequentially in a second time period, up to a n-th voltage level sequentially in a n-th time period, where $n \geq 2$.

11. A display apparatus comprising the display substrate of claim 10.

* * * * *